US005344478A

United States Patent [19]

Zurecki et al.

[11] Patent Number: 5,344,478

[45] Date of Patent: Sep. 6, 1994

[54] VORTEX DISPERSING NOZZLE FOR LIQUEFIED CRYOGENIC INERT GASES USED IN BLANKETING OF MOLTEN METALS EXPOSED TO AMBIENT AIR AND METHOD

[75] Inventors: Zbigniew Zurecki, Macungie; Kerry R. Berger; Robert B. Swan, both of Lehighton, all of Pa.

[73] Assignee: Air Products and Chemicals, Inc., Allentown, Pa.

[21] Appl. No.: 100,866

[22] Filed: Aug. 2, 1993

[51] Int. Cl.[5] ..... C22B 9/00

[52] U.S. Cl. ..... 75/709; 266/207

[58] Field of Search ..... 75/709; 266/207

[56] References Cited

U.S. PATENT DOCUMENTS

| | | | |
|---|---|---|---|
| 4,178,980 | 12/1979 | Gilbert et al. | 164/66 |
| 4,460,409 | 7/1984 | Devalois et al. | 75/96 |
| 4,518,421 | 5/1985 | Foulard et al. | 75/49 |
| 4,723,997 | 2/1988 | Lutgen | 75/584 |
| 4,915,362 | 4/1990 | Borasci et al. | 266/266 |
| 4,990,183 | 2/1991 | Anderson et al. | 75/555 |

*Primary Examiner*—Melvyn J. Andrews

*Attorney, Agent, or Firm*—James C. Simmons; William F. Marsh

[57] ABSTRACT

Method and apparatus for dispersing cryogenic inert gases over the surface of a bath of molten metal by separating vaporized cryogenic gas from the liquid phase of the gas and introducing the liquid phase and the gaseous phase onto the surface of the molten metal in a swirling pattern. Additional inert gas can be introduced into the middle of the liquid phase.

12 Claims, 3 Drawing Sheets

FIG. 2
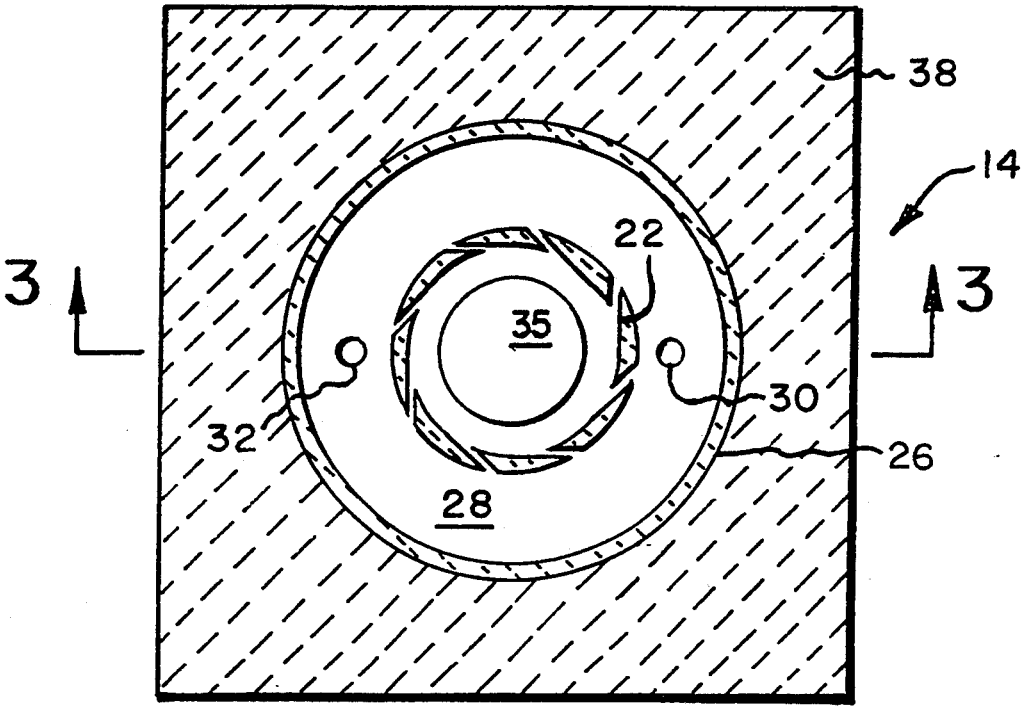
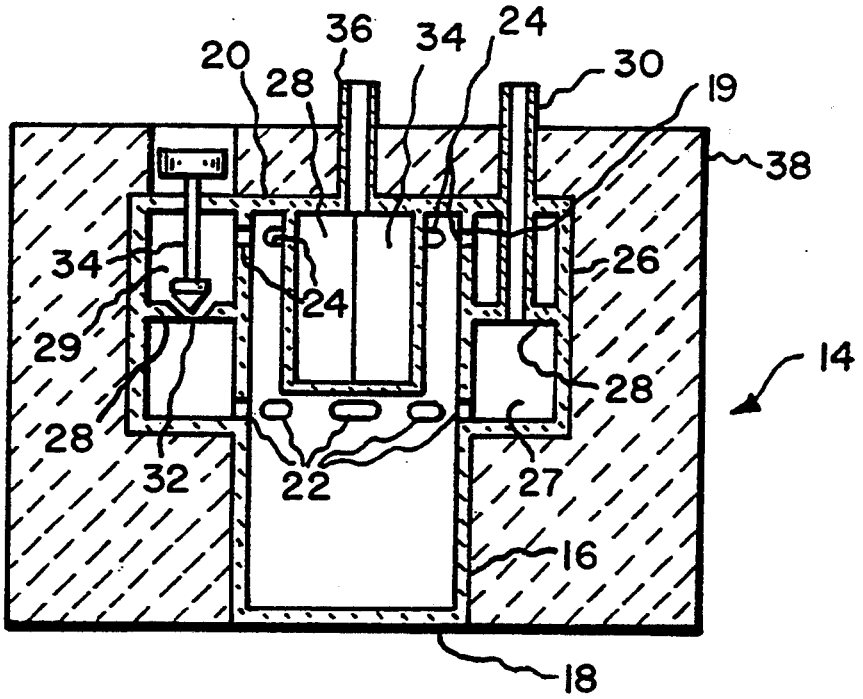
FIG. 3

VORTEX DISPERSING NOZZLE FOR LIQUEFIED CRYOGENIC INERT GASES USED IN BLANKETING OF MOLTEN METALS EXPOSED TO AMBIENT AIR AND METHOD

FIELD OF THE INVENTION

The present invention pertains to methods and apparatus for introducing an inert blanketing medium (e.g., liquefied cryogen) onto the surface of a bath of molten metal contained in a vessel such as a ladle or furnace.

BACKGROUND OF THE INVENTION

Molten metals processed in atmospheric air tend to oxidize and lose alloying additions, form slag causing difficulties in handling and wear of refractory material causing formation of non-metallic inclusions, absorb unwanted nitrogen and hydrogen from the air, resulting in poor metal quality and/or toxic fumes. In the past in order to minimize these problems, various protective coverings were used on a bath of molten metal exposed to the atmosphere. Examples of prior art techniques were the use of graphite or charcoal covers, liquid fluxing salts, synthetic slags, protective gaseous atmospheres or enclosing the vessel in a vacuum enclosure.

In the past, liquified cryogenic gases (e.g., nitrogen and argon) were successfully tried as a means for protecting molten metal surfaces. Use of direct application of liquified cryogenic gases to the molten metal surface has been limited because of lack of properly designed cryogenic sprayers that would assure uniform dispersion of the liquid cryogen over a large molten metal surface area without entraining excessive amounts of ambient atmosphere or excessive boil-off losses of cryogenic liquid. The prior art systems required an overly complex and/or manifolded piping, increased cost if liquified argon was used to blanket melts because of the composition of the reel t. The danger of a cryogenic liquid explosion is present if a concentrated and poorly dispersed stream of cryogen was trapped between the molten metal surface and a crust or layer of oxides or slag located on the surface of the molten metal.

The importance of dispersing of the cryogenic liquid in a proper fashion was largely unrecognized in the art. Foulard, et al. (U.S. Pat. No. 4,518,421) disclosed a process of evaporation-condensation refining of molten metals in a semi-closed container using a relatively straight tube to deliver cryogenic liquid to the molten metal surface.

Gilbert, et al. (U.S. Pat. No. 4,178,980) disclosed an annular phase separator to protect the stream of molten metal cast into a mold. The Patentees discharged the cryogen through inclined angular nozzles in the bottom of the annular separator thus minimizing air aspiration.

Devalois, et al. in U.S. Pat. No. 4,460,409 disclosed using a partly immersed converging cylindrical tube to confine the molten metal surface area being blanketed with the liquefied cryogen which is discharged through a narrow ended tube.

Anderson, et al. (U.S. Pat. No. 4,990,183) proposed blanketing an uncovered molten metal surface with liquid argon discharged either by a tube or a porous diffuser-separator under a closed lid covering ladle, laddles or laddle furnaces.

Borasci, et al. (U.S. Pat. No. 4,915,362) disclosed a carbon dioxide snow nozzle used to discharge massive amounts of this relatively inexpensive, but not really inert, solidified gas in order to compensate for the operating costs and the surrounding air entrained over the covered area by use of a high-velocity carbon dioxide jet.

The prior art shows the placement of cryogenic liquid near the covered molten metal surface limits entrained air and gas consumption/cost minimization were more or less successfully attempted with complex and difficult to implement geometrical arrangements around the cryogenic discharging devices or by compromising efficiency of uniform blanketing with cheaper reactive cryogenic gases or undeveloped cryogenic spray-separators.

SUMMARY OF THE INVENTION

The present invention relies upon the use of a swirling droplets of liquefied cryogen at low velocity to uniformly disperse liquefied cryogenic gases onto a swirling conical surface, thus enclosing a low pressure zone above the surface of the molten metal. According to the invention, premature boil-off of the cryogen is separated from the liquid and recombined with the liquid to further enhance the molten metal blanketing. A second cryogenic gas can be introduced into the center of the swirling cryogenic liquid to give the user an opportunity to shroud a more expensive cryogenic gas, and thus minimize the evaporation losses or premature evaporation losses of the second, more expensive cryogenic gas. The method and apparatus according to the present invention minimize aspiration of the surrounding air into contact with the surface of the molten metal being blanketed. The low pressure zone formed inside the apex of the conical blanket of liquefied cryogenic gas recycles the gas and fumes evaporated from the surface of the melt back into the center of the vortex. Thus a closed circuit extends the residence time of inert cryogen above the metal surface and improves both the effectiveness and cost efficiency of the blanketing process according to the present invention.

BRIEF DESCRIPTION OF THE DRAWING

FIG. 2 is a view taken along line 2—2 of FIG. 1.

FIG. 3 is a view taken along line 3—3 of FIG. 2.

DETAILED DESCRIPTION OF THE INVENTION

Figure 1:
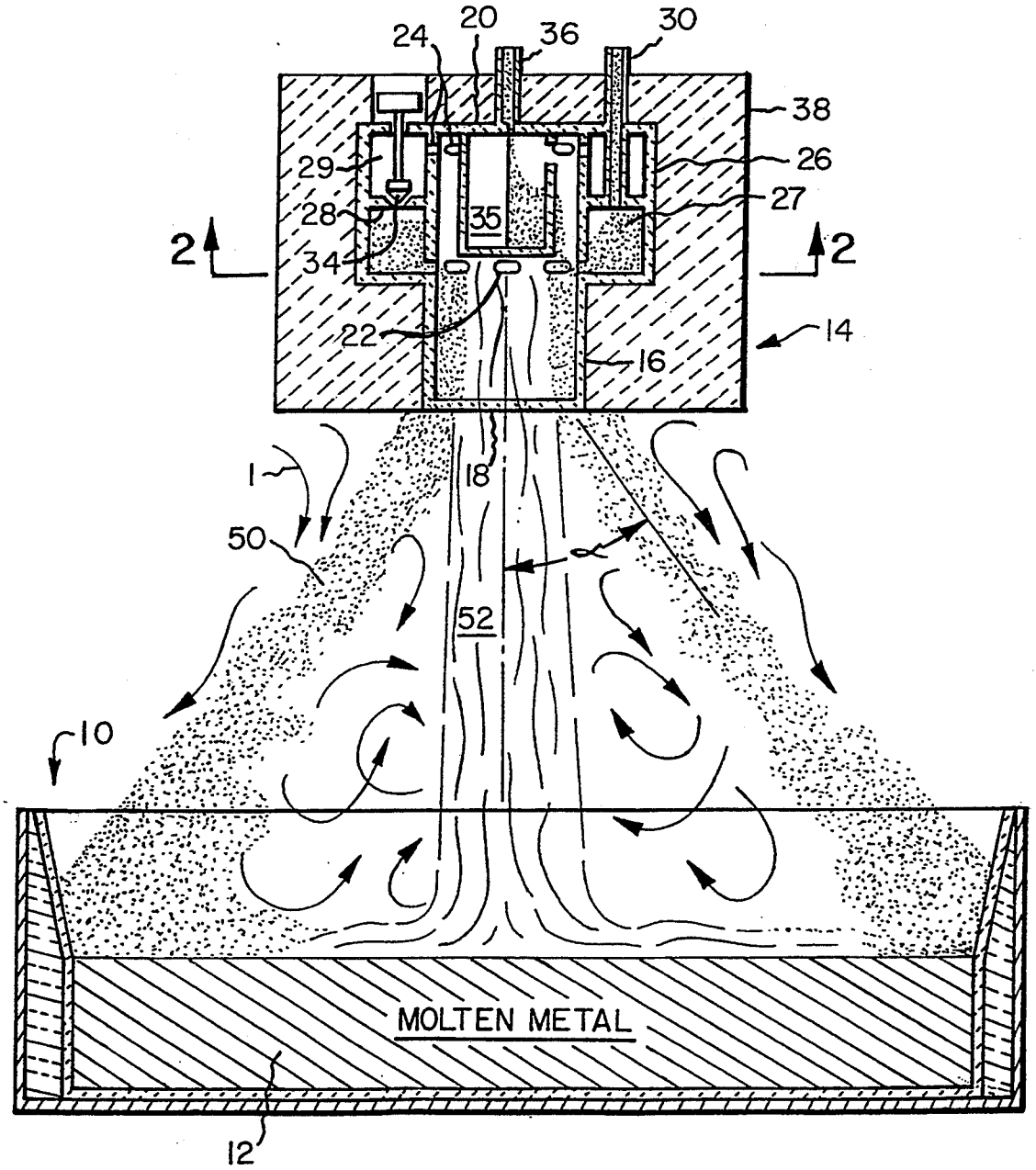
FIG. 1 is a highly schematic elevational representation of the apparatus and use thereof according to the present invention.

Referring to the drawing and in particular FIGS. 2 and 3, the apparatus of the present invention comprises a central or vortex tube shown generally as 16 having a first or cryogenic discharge end 18 and a second or media receiving end 19. A first set of at 1 east two tangential nozzles 22 is disposed approximately midway between the first and the second ends (18, 19) of the vortex tube 16. The nozzles shown in FIG. 2 are tangentially disposed and preferably a plurality of nozzles are spaced equidistant around the circumference of the vortex tube 16. It has been found that the nozzles are most effective if they are prepared so that the length to diameter (L/D) ratio is greater than 3.5. A second set of at least two, and preferably a plurality of identical nozzles 32, is disposed adjacent the second end 19 of the vortex tube 16.

A jacket 26 surrounds the vortex tube 16 and extends from a location just below the first row of nozzles 22 and terminates in the same plane as the second end 19 of the vortex tube 16. Jacket 26 is closed by a fluid tight cover 20 which also serves to close the second end 19 of the vortex tube 16. Jacket 26 is divided into two chambers by an annular fluid tight wall 28 which divides the jacket 26 into a lower chamber which surrounds and communicates with the first row of apertures 22 and an upper chamber which communicates with the second row of apertures 24. Wall or cover 20 includes a fluid tight cryogen inlet conduit 30 for conducting liquefied cryogen to the lower chamber 27. Wall 28 includes an aperture 32 (FIG. 3) closed by a valve 34 so that cryogenic liquid boil-off gases can be removed from the lower chamber 27 into the upper chamber 29. Upper chamber 29 communicates through apertures 24 to the vortex tube 16.

Optionally a diffuser 35 can be disposed centrally within a vortex tube 16 to admit via conduit 36 a liquid or gaseous cryogen into the center of the vortex tube 16.

The entire assembly of the central vortex tube 16, surrounding jacket 26, inlet conduits 30 and 36, can be encased in a refractory material 38 to further insulate the vortex tube 16 and prevent or minimize premature cryogen boil-off.

Referring to FIG. 1, the assembly of the vortex tube 16 and surrounding refractory material 38 is disposed above a reservoir 10 containing molten metal 12. Reservoir 10 can be a ladle, a furnace or any other device used to contain molten metal exposed to ambient atmosphere.

In a first embodiment of the invention media consisting of a liquefied cryogen, e.g. nitrogen is conducted through conduit 30 to the lower chamber 27 and outwardly thereof through apertures 22 wherein in a swirling pattern falls toward the surface of the molten metal 12. The liquefied cryogen 50 exiting the vortex tube 16 forms a conical pattern as shown. Premature boil-off (gaseous cryogen) in chamber 27 is conducted to chamber 29 by open valve 34. Gaseous cryogen in chamber 29 enters the vortex tube through apertures or nozzles 24 and is mixed with the liquefied cryogen 50 to further blanket the surface of the molten metal.

The vortex tube 16 tangentially oriented small nozzles 22, 24 discharge cryogen in the manner shown to uniformly disperse the cryogenic inert liquid/gas over a large surface area of molten metal thus preventing localized accumulation of liquefied cryogens and minimizing explosion hazards as well as aspiration of ambient air into the blanketed area.

As shown in FIGS. 1, 2 and 3, a diffuser 35 can be disposed axially inside of the vortex tube 16, the diffuser 35 being connected via conduit 36 to a source of cryogenic liquid or gas which may be the same as the liquid in conduit 30 or may be different. The liquid (gas) exiting the diffuser 35 is directed at the surface of the molten bath 12 and is dispersed along the surface being protected by the initial cryogenic liquid gas mixture 50. What is most important about the use of the second diffuser 35 is that it permits a different cryogenic liquid, e.g. more expensive argon, to be used in blanketing the molten metal and losses of argon can be delayed by using a less expensive cryogen, e.g. liquid nitrogen, as the primary or shielding cryogen introduced via conduit 30 into the vortex tube 16. Since the axial stream of liquid argon 52 discharged from diffuser 35 spreads on unoxidized surface of molten metal 12, the risk of boil-off explosion resulting from entrapment of the cryogen between the metal and top slag layer is eliminated.

Figure 4:
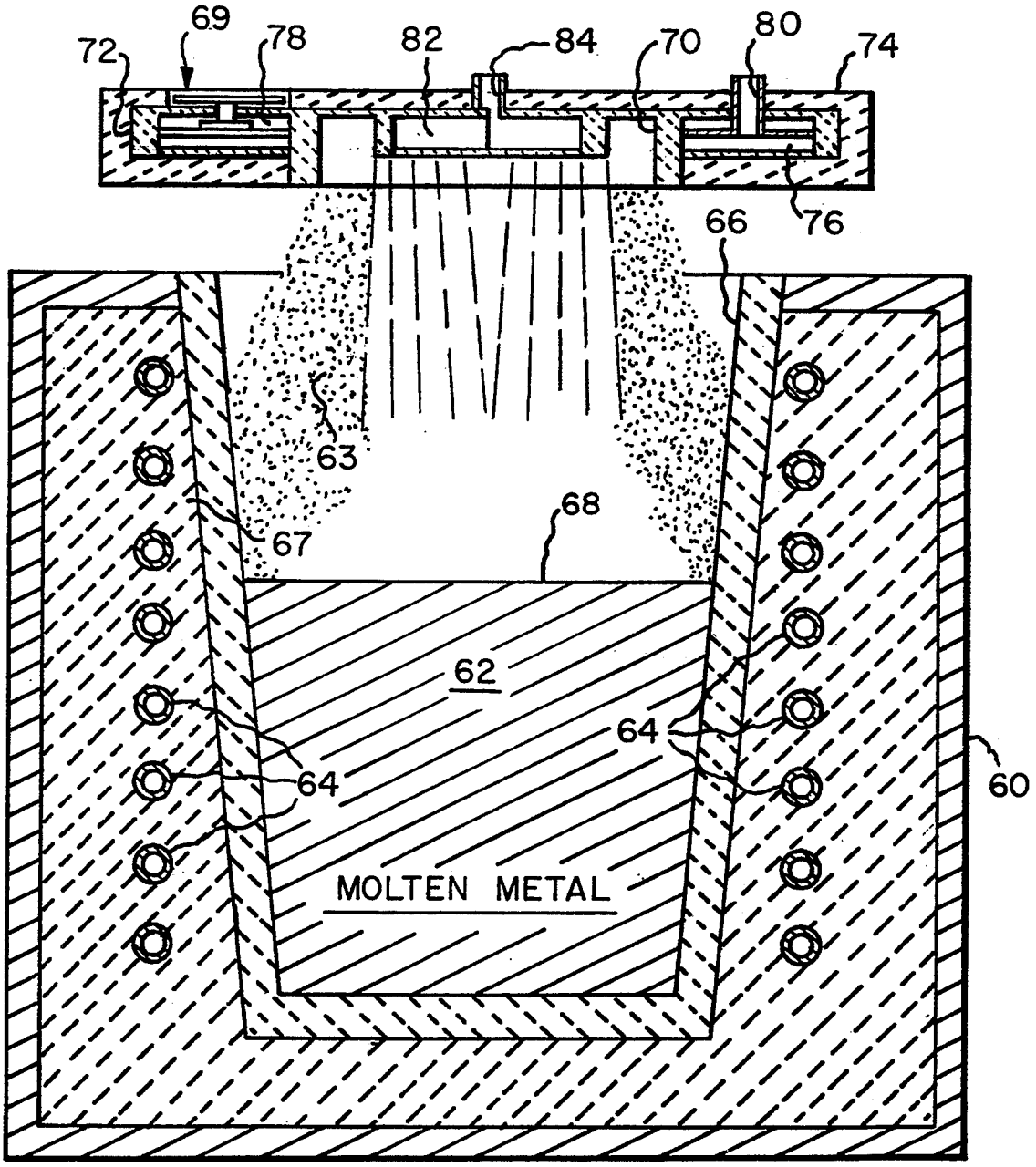
FIG. 4 is a schematic representation of an alternate embodiment according to the present invention.

Referring to FIG. 4, there is shown a furnace 60 which may be an induction furnace for reel ting metal s such as aluminum to produce a molten bath 62 via conventional resistance heating elements 64. Disposed above the open top 66 of the induction furnace 60 and the surface of the molten metal 68 is a flattened version of the apparatus of the invention shown generally as 69. The apparatus 69 is so constructed that the central vortex tube 70 is of a larger diameter and a shorter length. The vortex tube 70 is surrounded by a jacket 72 identical to the jacket of the apparatus in FIGS. 1–3, 72 and the entire apparatus can be enclosed in a refractory material 74. The jacket 72 has a lower chamber 76 and an upper chamber 78, the lower chamber 76 receiving the liquefied cryogen through a conduit 80 and the upper chamber 78 receiving gaseous boil-off for introduction into the vortex tube 70 through apertures 82. Liquefied cryogen is introduced through tangential apertures (not shown) similar to those in the apparatus in FIGS. 1–3. A second cryogenic gas can be introduced to a central diffuser 82 via conduit 84 in the manner of the apparatus and method of FIGS. 1–3. The device of FIG. 4 introduces a shrouded cryogenic liquid in the same manner as the apparatus in FIGS. 1–3.

A vortex sprayer according to the invention was constructed with vortex tube 16 having a diameter of 2" and the jacket having a diameter of 3". Nozzles 22 and 24 were a series of 16 holes each having a 1/16" diameter by a $\frac{1}{4}$" length. With the valve 34 open and no surrounding insulation 38 and no second cryogen being introduced through 36, liquid argon at 3 to 5 pounds per minute supplied to a molten steel bath in a 20" diameter induction furnace was able to maintain a constant level of 1–2 volume percent oxygen above the molten surface. The same amount of liquid argon dripped from straight $\frac{1}{4}$" diameter tube or a 1.5" diameter porous diffuser produced unstable oxygen levels that varied from 2–16% across the melt surface and resulted in formation and piercing of a semi-crusty-semi-liquid slag oxide layer.

In order to utilize the method and apparatus of the present invention the user/operator must locate the device 14 above the molten metal surface at the height that provides the desired coverage. This is generally determined by the formula $R/H = \text{tangent } \alpha$, where H is the distance from the discharge 18 of the vortex tube to the surface of the molten bath 12, R is the radius of the surface of the molten bath, $\alpha$ is the angle between the axis of the vortex tube and the initial cryogenic liquid surface 50, and the value of the angle $\alpha$ increases from 30 degrees for a flowrate of cryogen of 2 pounds per minute to 45 degrees for a flowrate of cryogen of 10 pounds per minute. The valve 34 is open at the same time the cryogen is introduced into conduit 30 and if desired conduit 36. There is a delay of approximately 30–45 seconds where the source gas pressure is between 15 and 75 psig for the cryogenic liquid to exit tube 16 in a vortex shape.

According to the present invention the vortex sprayer uniformly disperses cryogenic gases into a swirling conical surface enclosing a low pressure zone within and at the exit of vortex tube 16. The liquid droplet swirl falls at a low velocity into the vessel containing the molten metal. Thus, the aspiration surrounding air into the vessel is minimized. On the other hand, the low pressure formed inside the apex of the cone recycles the gas and the fumes evaporated from the melt surface back into the center of the vortex nozzle. This closed-circuit extends the residence time of the inert cryogen above the metal surface and improves both the effectiveness and the cost efficiency of the cryogenic blanketing process.

If a second cryogenic gas is introduced into the vortex sprayer through the apparatus 35, the external cryogenic cone is effectively protecting or shrouding the second gas stream from evaporation. This effect is extremely useful if liquid argon is required for blanketing a molten metal bath. In the case of the use of liquid argon, an inexpensive liquid nitrogen shield can be created by introducing liquid nitrogen through the conduit 30 to shroud the liquid argon being introduced through the diffuser 35. The combined cost of the consumed gases will be lower than for the use of liquid argon by itself. Nitrogen pick-up by the metal is minimal because of the mostly sacrificial-cooling role of the liquid nitrogen in the liquid nitrogen plus liquid argon spraying mode.

Again, the method and apparatus of the present invention result in a uniform, effective and safe dispersion of liquid nitrogen and/or liquid argon, cryogenic blankets over molten metal surface were clean and non-polluting processing of metals in foundries.

The method and apparatus of the present invention can be used with a broad range of media in addition to cryogenic, e.g. compressed liquid hydrocarbon gases or oils which would, after introduction to the surface of the metal, boil off and blanket the molten metal surface and/or burn in the surrounding atmosphere.

Having thus described our invention what is desired to be secured by Letters Patent of the United States is set forth in the appended claims.

We claim:

1. An apparatus for introducing blanketing media onto the surface of a molten metal bath comprising in combination:

a central vortex tube having a discharge end and a media receiving end;

a first set of at least two tangential nozzles extending through and disposed equidistant circumferentially around said vortex tube and inwardly of said first end;

a second set of at least two tangential nozzles disposed equidistant extending through and circumferentially around said vortex tube between said first row and said second end of said vortex tube;

a chamber or jacket surrounding said vortex tube, said jacket constructed in fluid tight relationship to said vortex tube and communicating with said first and second rows of nozzles, said jacket divided into two separate fluid reservoirs consisting of a first reservoir communicating with said first set of nozzles and a second reservoir communicating with said second set of nozzles;

means for introducing a liquid media into said first reservoir; and means to controllably remove vaporized media from said first reservoir into said second reservoir.

2. An apparatus according to claim 1 wherein said first and second set of nozzles are a plurality of nozzles disposed in a circumferential row.

3. An apparatus according to claim 1 wherein each nozzle has a length to diameter ratio (L/D) greater than 3.5.

4. An apparatus according to claim 1 wherein said vortex tube and jacket are surrounded by a refractory material.

5. An apparatus according to claim 1 wherein there is included in said vortex tube means a gaseous diffuser for introducing inert media into said vortex tube.

6. An apparatus according to claim 1 wherein said first and second reservoirs are in fluid tight communication with each other and with said vortex tube and said means to controllably remove vaporized cryogen from said first reservoir includes a valve between said first and second reservoirs.

7. An apparatus according to claim 1 wherein said means for introducing media is adapted for introducing a cryogenic liquid into said vortex tube.

8. An apparatus according to claim 1 wherein said means for introducing media is adapted for introducing a compressed liquid hydrocarbon into said vortex tube.

9. A method of blanketing the surface of a molten metal with inert liquid media comprising the steps of:

introducing a liquefied inert media into a reservoir disposed proximate said surface of said molten metal;

removing vaporized liquid from said reservoir; and introducing said liquefied inert media and vaporized inert media onto said surface of said molten metal in the form of a swirling pattern of liquid media into which said vaporized media has been entrained.

10. A method according to claim 9 wherein an inert gas is introduced inside said liquefied media.

11. A method according to claim 9 wherein said inert liquid media is compressed liquid hydrocarbon.

12. A method according to claim 11 wherein said liquid hydrocarbon is a gas or liquid at ambient temperature and pressure.

* * * * *